US006468044B1

(12) United States Patent
Bishop et al.

(10) Patent No.: US 6,468,044 B1
(45) Date of Patent: Oct. 22, 2002

(54) VARIABLE DISPLACEMENT PUMP

(75) Inventors: Leonard F. Bishop, Sterling Hts., MI (US); Shawn P. Cap'ser, Monroe, MI (US); John D. Dalpiaz, New Boston, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/595,383

(22) Filed: Jun. 15, 2000

(51) Int. Cl.[7] ..... F04B 49/00; F04B 23/00
(52) U.S. Cl. ..... 417/220; 417/310; 417/440
(58) Field of Search ..... 417/310, 440, 417/220

(56) References Cited

U.S. PATENT DOCUMENTS

| | | | | |
|---|---|---|---|---|
| 2,238,061 | A | 4/1941 | Kendrick | |
| 3,067,693 | A | 12/1962 | Lambeck | |
| 4,067,664 | A | 1/1978 | Robeller | |
| 4,325,677 | A | 4/1982 | Nonnenmacher | |
| 4,405,288 | A | 9/1983 | Stockton | |
| 4,468,173 | A | 8/1984 | Dantlgraber | |
| 4,485,883 | A | 12/1984 | Duffy | |
| 4,518,322 | A | 5/1985 | Nonnenmacher | |
| 4,531,893 | A | 7/1985 | Okoh et al. | |
| 4,710,106 | A | 12/1987 | Iwata | |
| 5,518,380 | A | 5/1996 | Fujii et al. | |
| 5,538,400 | A | 7/1996 | Konishi et al. | |
| 5,562,432 | A | * 10/1996 | Semba et al. | 418/26 |

FOREIGN PATENT DOCUMENTS

| | | |
|---|---|---|
| DE | 2363480 | 6/1975 |
| DE | 2448469 | 4/1976 |
| DE | 10004028 | 8/2000 |
| JP | 56-146085 | 11/1981 |
| JP | 57-62986 | 4/1982 |
| JP | 57-131888 | 8/1982 |
| JP | 57-131889 | 8/1982 |
| JP | 59-70891 | 4/1984 |
| JP | 3199684 | 8/1991 |

* cited by examiner

*Primary Examiner*—Charles G. Freay
(74) *Attorney, Agent, or Firm*—John E. Kajander, Esq.

(57) ABSTRACT

A variable displacement pump (28) having a combination inlet port (71) and an outlet (76) formed integrally on the rear body (32). By integrating the combination inlet port (71) and outlet (76) on the rear body (32), this invention simplifies the manufacture of the pump (28) as compared with known variable displacement pumps.

7 Claims, 4 Drawing Sheets

VARIABLE DISPLACEMENT PUMP

TECHNICAL FIELD

The present invention relates to fluid pumps and, more particularly, a variable displacement pump suitable for use in automobiles.

BACKGROUND

Power-assisted steering systems are systems used to aid drivers in controlling vehicles on the roads at low and high speeds by providing assistance to drivers in turning the steering wheel under various conditions. Power steering systems typically comprise a rack-and-pinion steering gear mechanism in which the gear rack is connected to a steering gear linkage and to the piston of a fluid motor. The rack engages a pinion gear that is connected to a driver operated steering shaft. A power steering pump is typically coupled to the rack-and-pinion gear mechanism to provide steering assistance to the rack-and-pinion gear mechanism as necessary. The power steering pump uses a rotary valve mechanism to control distribution of pressure from a power steering pump to the fluid motor portions of the rack-and-pinion steering gear mechanism. One type of power steering pump typically used in automotive systems is the constant displacement rotary vane pump.

Constant displacement rotary vane pumps of the type used in power steering devices have a flow rate proportional to rotor speed. The steering gear supplied with pressurized hydraulic fluid from the pump requires high flow rates when vehicle speed is low and low flow rates when vehicle speed is high. With a constant displacement pump, however, the flow of hydraulic fluid from the pump is controlled by the rotor speed, and not by the amount of steering assistance needed. Excess hydraulic fluid is bypassed internally within the pump, creating heat and excess torque, which adversely affects fuel economy.

To improve the feel of a power steering system at all speeds and to make the system more fluid economical, conventional power steering systems may use electronic variable orifice (EVO) power steering systems. In an EVO power steering system, the fixed orifice of a power steering system is removed in the pump assembly and replaced with an EVO actuator. The EVO actuator is a flow control valve that is threaded onto the outlet of the pump which regulates flow rate as a function of vehicle speed as determined by an algorithm control. The EVO system works by providing high flow rates to the steering gear at low vehicle speeds (EVO actuator fully open) and lower flow rates as vehicle speeds increase (EVO actuator begins to close). A hand wheel speed sensor is typically used to in conjunction with the EVO system to increase steering assistance when it senses that the vehicle operator is making an evasive maneuver. The excess flow that the pump produces in high or low speed situations is normally bypassed internally within the pump.

Recently, improvements have focused on alleviating the excess flow that must be bypassed internally within the pump. To accomplish this, a variable displacement pump replaces the constant displacement pump. The variable displacement pump controls pressure on the outer surface of a movable cam ring to vary the volume of fluid passing through the pump. In this way, the flow of fluid through the pump can be controlled during either low-speed or high-speed operations. Also, less fluid may be bypassed internally within the pump, decreasing excess heat and torque that affects fuel economy. However, currently available variable displacement pumps have complex designs that are expensive to manufacture.

SUMMARY OF THE INVENTION

It is thus an object of the present invention to simplify the design of the variable displacement pump by providing a variable displacement pump where the outlet port is formed integrally to the rear body of the pump.

It is another object of the present invention to simplify the design of the variable displacement pump by providing a variable displacement pump where the combination inlet port is formed integrally to the rear body of the pump.

The present invention simplifies the design of conventional variable displacement pumps by integrating the combination fluid inlet and the fluid outlet into the rear body. Although the new design adds some complexity to the rear body, the overall pump design is less costly to manufacture than previous arrangements.

Other objects and advantages of the present invention will become apparent upon considering the following detailed description and appended claims, and upon reference to the accompanying drawings.

DESCRIPTION OF THE PREFERRED EMBODIMENT(S)

Figure 1:
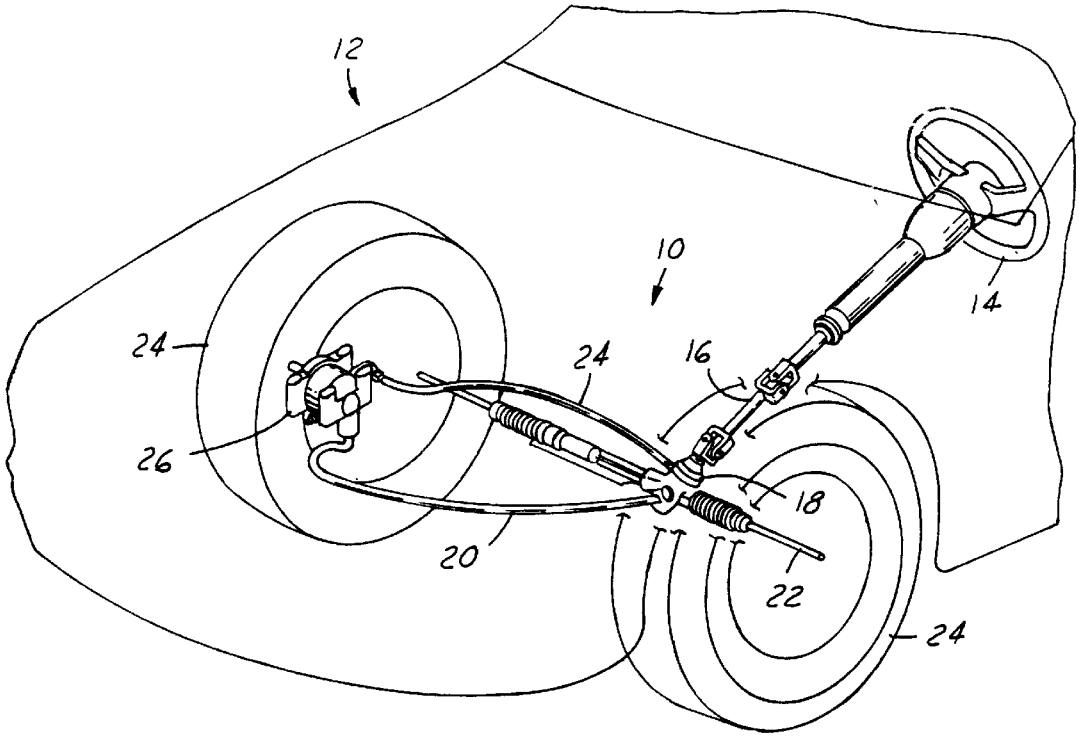
FIG. 1 is a high level perspective view of a vehicle having a hydraulic power rack and pinion steering system.

Referring to FIG. 1, a hydraulic power rack and pinion steering assembly 10 of a vehicle 12 according to a preferred embodiment is shown. The assembly 10 also has a steering wheel 14, a steering shaft 16, a gear housing 18, a power cylinder (not shown), hydraulic lines 20, a pair of tie rods 22, tires 24, and a power steering pump 26. The power steering pump 26 is typically a rotary valve mechanism.

In operation, when the steering wheel 14 is turned, the weight of the vehicle 12 causes the front tires 24 to resist turning. This twists the steering shaft 16, which in turns twists a torsion bar (not shown) or thrusts a pinion shaft within the gear housing 18, making the control valve (not shown) on the gear housing 18 to move and align specific fluid passages. Pump pressure then flows through the rotary valve mechanism in the pump 26, out the hydraulic lines 20, and into the power cylinder. Pressure then acts on the power piston (not shown) contained within the gear housing 18 to help assist the rack and front wheels 24 for turning.

FIGS. 2–6 show various perspective and cross-sectional views of a vane-type variable displacement pump 28 according to a preferred embodiment of the present invention.

Figure 3:
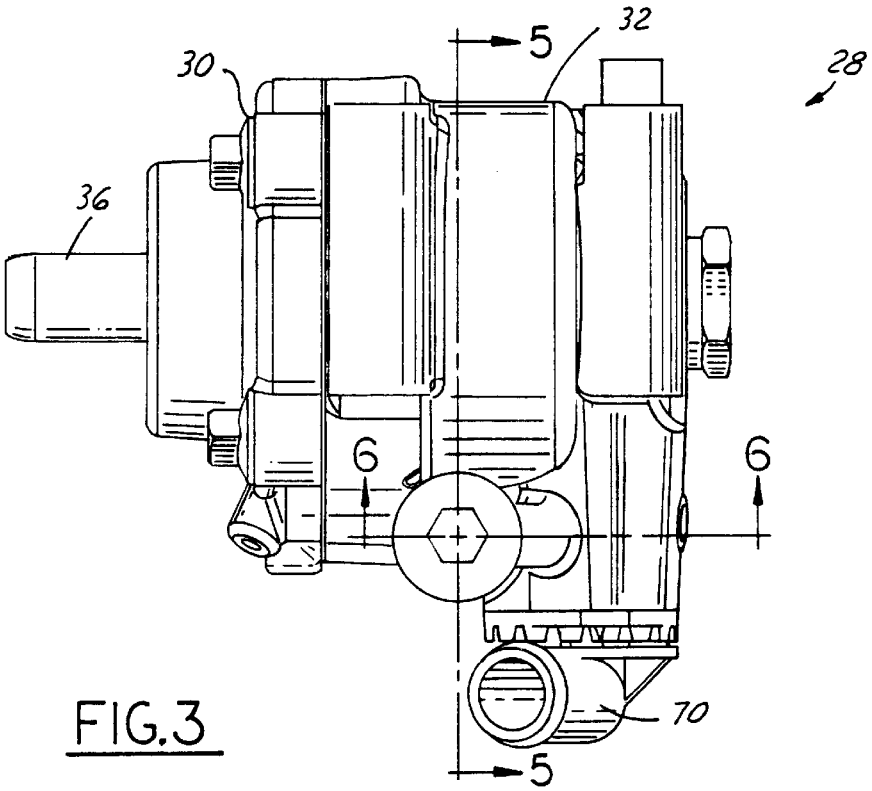
FIG. 3 is another perspective view of FIG. 2 rotated 90 degrees.
Figure 2:
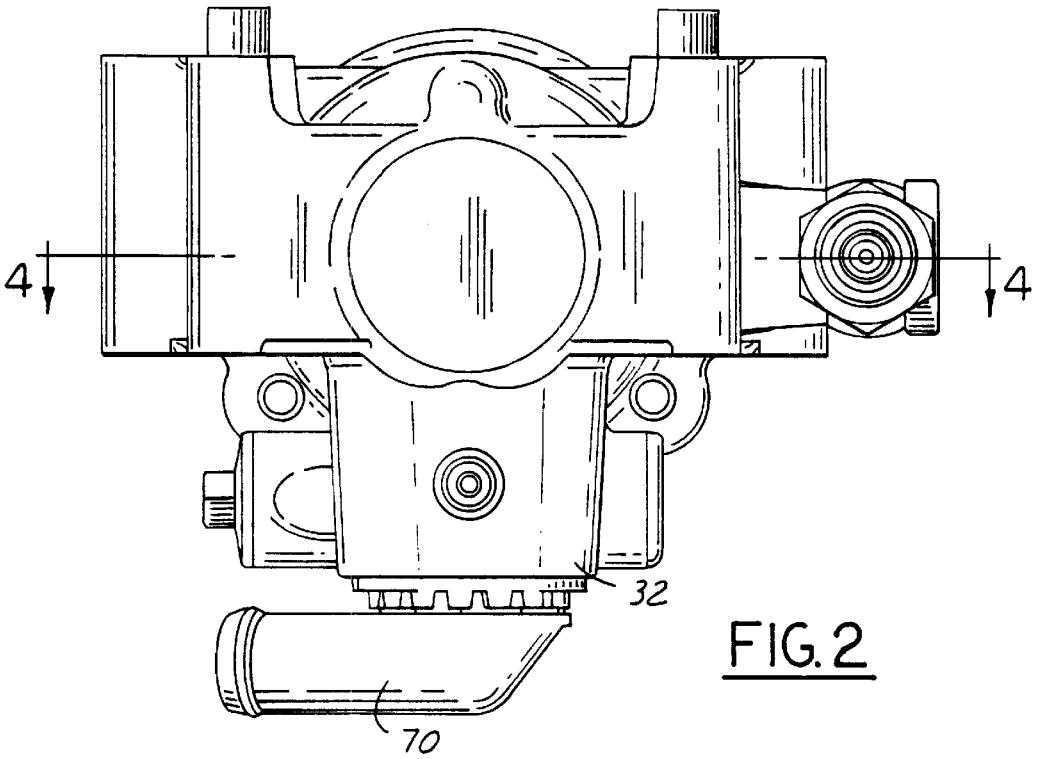
FIG. 2 is a perspective view of the outer housing of a power steering pump according to a preferred embodiment of the present invention.

In FIGS. 2 and 3, a high-level perspective view of a preferred embodiment of the pump 28 according to the present invention is illustrated in two views rotated 90 degrees relative to each other. The pump 28 has a front body 30 and a rear body 32. A fluid inlet 70 is integrally formed on the rear body 32.

Figure 4:
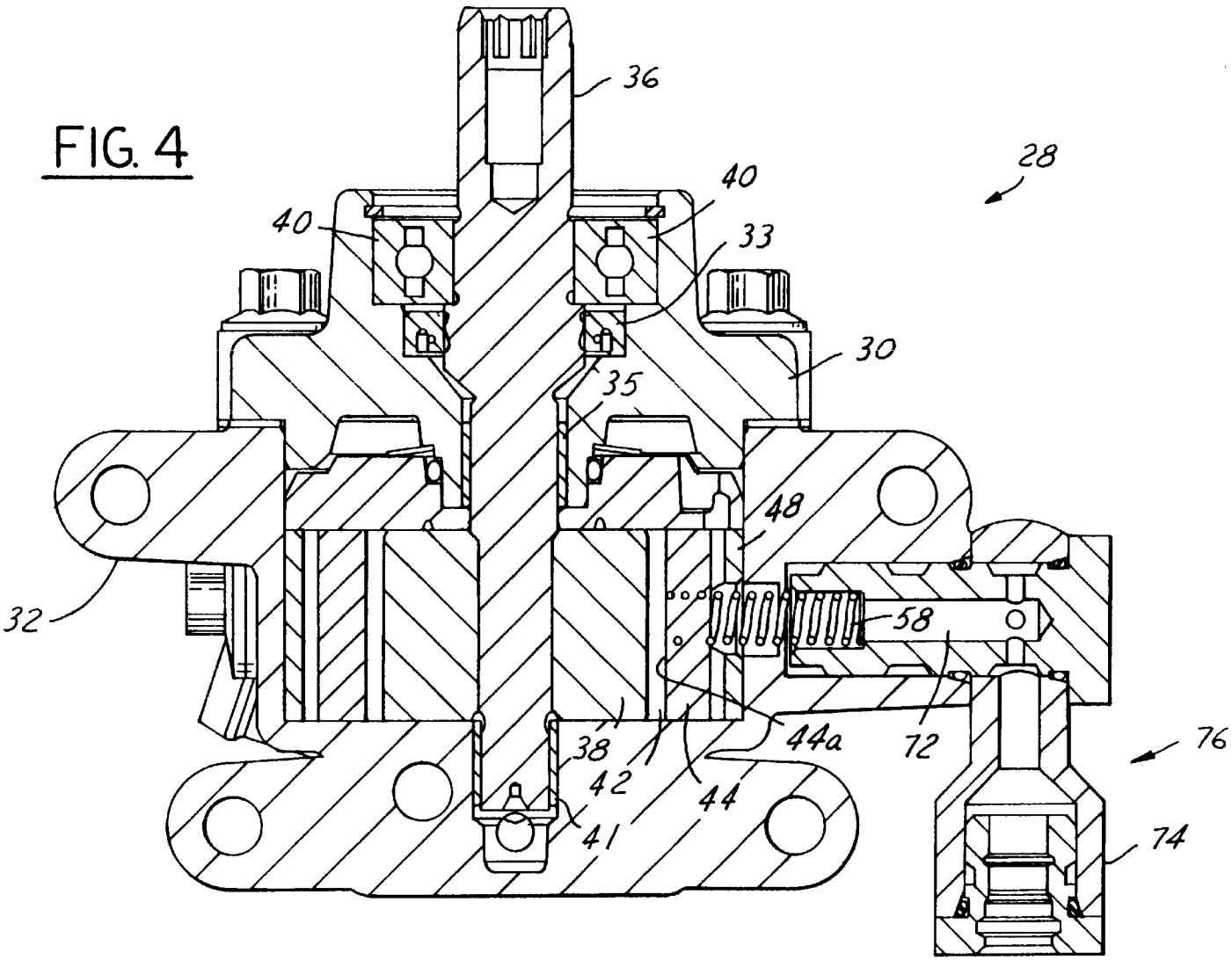
FIG. 4 is a cross-sectional view of FIG. 2 taken along line 4—4.

As best shown in FIG. 4, a drive shaft 36 for driving a rotor 38 is fitted into the front body 30 and is rotatably supported by bearings 40 on the side of the rear body 32. A shaft seal 33 and a bushing 35 are also pressed between the front body 30 and the shaft. In addition, a bearing 41 is pressed between the rear body 32 and the shaft 36. A cam ring 44 having an inner cam surface 44*a* is fitted around the outer periphery of the rotor 38 and within an outer ring 48. The rotor 38 has vanes 42 placed within the rotor slots (shown as 38*a* on FIG. 5). A cam spring 58 is secured within the discharge chamber 72 and urges the cam 44 away from the discharge chamber 72. The discharge chamber 72 is fluidically coupled to the fluid outlet 74, which is integral with the rear body 32. While the fluid outlet 74 is shown as being perpendicular with the discharge chamber 72 in FIG. 4, it is understood that the fluid outlet 74 could extend along the plane of the discharge chamber 72.

Figure 5:
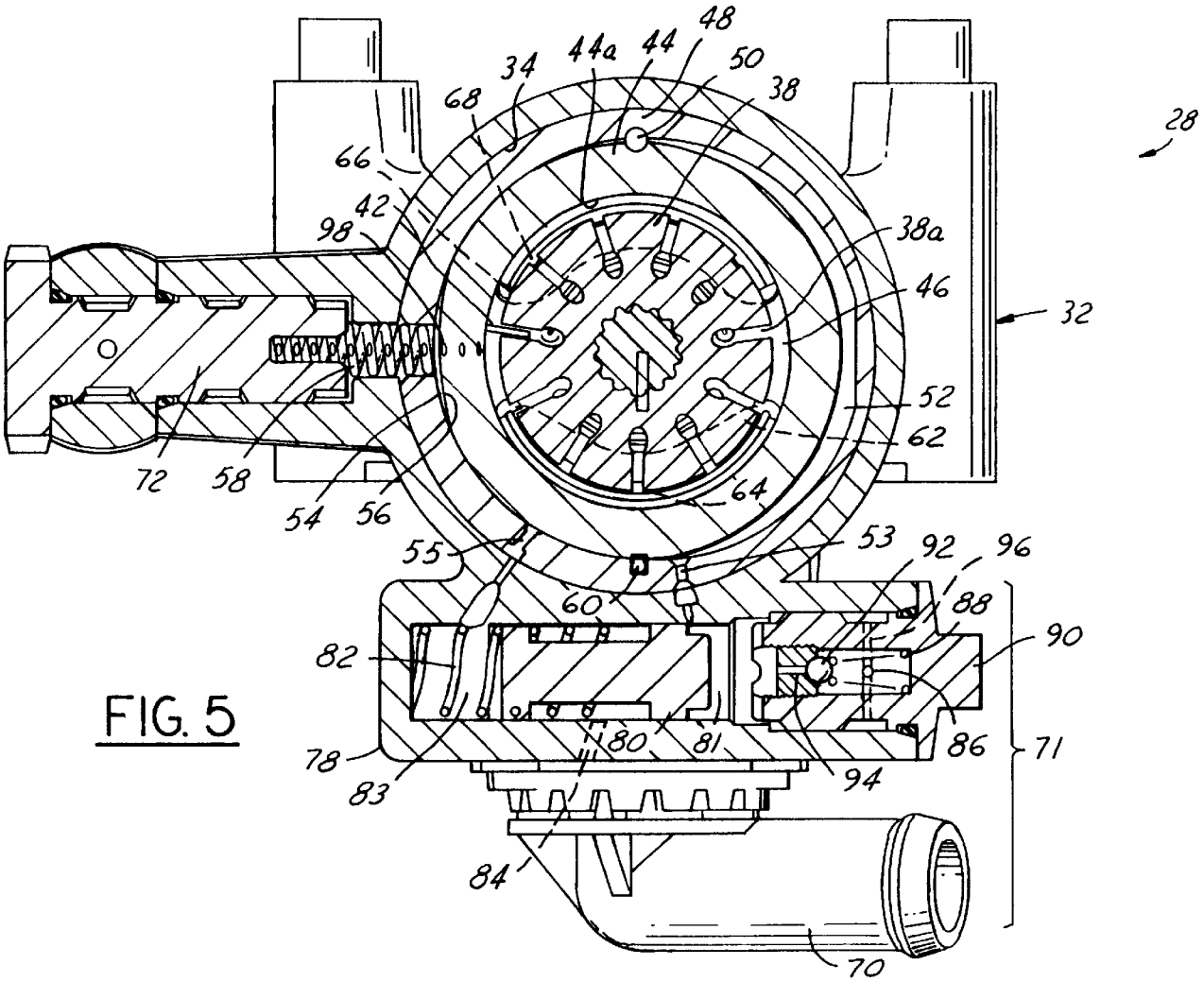
FIG. 5 is a cross-sectional view of FIG. 3 taken along line 5—5.

FIG. 5 is a cross-sectional view of FIG. 3 taken along line 5—5. The cam ring 44 forms a pumping chamber 46 between the inner cam surface 44*a* and the rotor 38. An outer ring 48 is used for holding the cam ring 44 movably and displaceably within the accommodating space 34 in the rear body 32. In this arrangement, the volume of fluid in the pump chamber 46 varies as a function of the position of the cam ring 44 disposed within the outer ring 48. An alignment pin 50 secures the outer ring 48 to the rear body 32 and functions as a pivotally supporting portion for the swinging displacement of the cam ring 44.

Further, reference numerals 52, 54 designate a pair of fluid-pressure chambers which become high- and low-pressure sides each formed on the outer periphery of the cam ring 44 in the elliptical space 56 of the outer ring 48. Passages 53 and 55 are fluidically coupled to the chambers 52, 54 and used for introducing fluid pressure for swinging and displacing the cam ring 44. When fluid pressure is introduced to the low-pressure chamber 54 through passage 55 or when fluid pressure is introduced to the high-pressure chamber 52 through passages 53, the cam ring 44 is swung and displaced in a desired direction to render variable the volume in the pumping chamber 46. A cam spring 58 is positioned near the low-pressure chamber 54 so that the pumping chamber 46 volume is normally maintained at a maximum level. In addition, a wiper seal 60 is positioned on the outer periphery of the cam ring 44 so as to define high-pressure chamber 52 and low-pressure chamber 54 with the pivotably supporting alignment pin 50 provided on the outer periphery thereof.

Also, a spool valve chamber 78 is formed integrally on the rear body 32. The spool valve chamber 78 and the fluid inlet 70 comprise the combination inlet port 71.

Reference number 62 designates a pump-suction side opening which is open in face-to-face relation to a pump-suction region 64 in the pump chamber 46. Reference number 66 designates a pump-discharge opening which is open in face-to-face relation to a pump-discharge region 68. Fluid is received into the pump-suction side chamber 62 through a fluid inlet 70 of a combination inlet port 71. Fluid is then discharged through a discharge chamber 72 contained within the cam spring 58 to an outlet chamber 74. Collectively, the discharge chamber 72 and outlet chamber 74 comprise the fluid outlet port 76. The fluid outlet port 76 then provides hydraulic fluid to various equipment such as a power steering apparatus. The fluid outlet port 76 is integrally formed on the rear body 32 of the power steering pump 28.

The fluid inlet 70 receives fluid from the reservoir (not shown) that the pump 28 will provide to various steering components. The fluid inlet 70 has three passages through which fluid may flow. First, fluid may flow through the pumping chamber passage 73 to the pump-suction side chamber 62. Second, fluid may flow through the rotor inlet passage 75 and behind the shaft seal 33. Third, fluid may flow through the inlet passage 84 and into the spool valve chamber 78.

Figure 6:
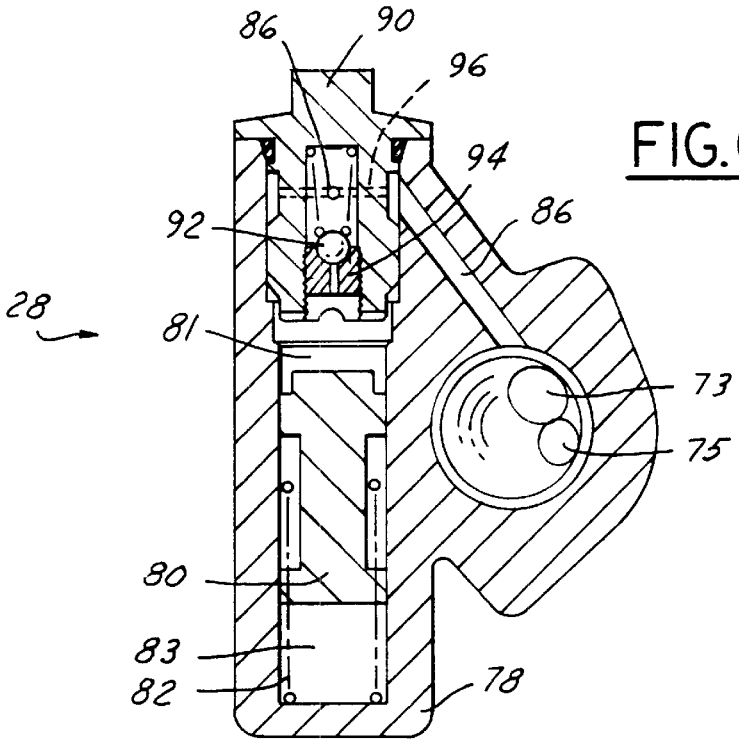
FIG. 6 is a cross-sectional view of FIG. 3 taken along line 6—6.

As best seen in FIGS. 5 and 6, the spool valve chamber 78 has a spool valve 80, a valve spring 82, an inlet passage 84, a pressure release valve 90, a pressure relief spring 88 and the previously mentioned pump-suction opening 62 and pump-discharge opening 66. The pressure relief valve 90 has a relief valve inlet 94, a ball 92, and a relief valve outlet 96. The relief valve outlet 96 is fluidically coupled to the pressure relief passage 86.

The spool valve chamber 78 contains a spool 80 biased against a spool valve spring 82. This forms two chambers in the spool valve chamber 78, a first chamber 81 on the upstream side and a second chamber 83 on the downstream side that contains the spool valve spring 82.

The spool valve chamber 78, in operation, has two functions. First, at higher vehicle speeds, fluid pressure builds up across the outlet orifice 98, and correspondingly in the first chamber 81, pushing the spool valve 80 in a translational direction towards the valve spring 82 and exposing passage 53 in the first chamber 81. This fluid pressure travels through the passage 53 into the high-pressure chamber 52, causing the cam ring 44 to urge against the cam spring 58. The excess volume of fluid pressure in the low-pressure chamber 54 is then pushed through passage 55 and into the second chamber 83. As explained above, this action decreases the pumping chamber 46 volume. Excess pressure in the first chamber 81 causes the ball 92 to move in a translational direction towards the pressure relief spring 88, thereby exposing a relief valve outlet 96. Excess fluid pressure may then exit the first chamber 81 through the relief valve outlet 96, through the passage 86, and return to a reservoir (not shown).

At lower pressures, the spool valve 80 is normally biased to cover the passage 53. In this position, the cam ring 44 is urged away from the cam spring 58, and the pumping chamber 46 volume is increased. Also, fluid pressure escapes from the second chamber 83 through the passage 55 and into the low-pressure chamber 54.

By making adjustments to fluid inlet 71 levels and spring 58, 82 biases, a nearly constant level of fluid may be pumped through the fluid outlet 74 for a particular application regardless of vehicle speed. For example, the fluid level delivered through the pump 28 could be maintained at a rate of 2.6 gallons per minute for a particular application. At higher speeds, the rotor 38 will rotate quicker, but with lower pumping chamber 46 volume between each set of vanes 42. At lower speeds, the rotor 38 will rotate slower, but with higher pumping chamber volume 46 between each set of vanes 42. Of course, the pumping chamber volume 46 may approach a flow rate of 0.0 gallons per minute, thus eliminating the need for hydraulic fluid to by bypassed within the pump 28, which can improve fuel economy.

Another advantage of conventional variable displacement pumps such as in the present invention over previous displacement pumps is that the pressure relief valve 90 prevents the buildup of discharge-side fluid pressure. When excess pressure is built up within the first chamber 81, the ball 92 will move towards the pressure relief spring 88, exposing the pressure relief outlet 96. Thus, excess fluid pressure is released through the outlet 96 and passage 86 and returns to a reservoir (not shown).

The present invention simplifies the design of conventional variable displacement pumps by integrating the combination fluid inlet 71 and the fluid outlet port 76 into the rear body 32. This simplified design adds little complexity to the rear body 32 and is less costly to manufacture than previous arrangements.

While the invention has been described in terms of preferred embodiments, it will be understood, of course, that the invention is not limited thereto since modifications may be made by those skilled in the art, particularly in light of the foregoing teachings.

What is claimed is:

1. A variable displacement pump comprising:

a pump body having a front body and a rear body;

a combination inlet port, said combination inlet port comprising a fluid inlet and a spool valve chamber; and a fluid outlet port for delivering fluid from the variable displacement pump, said fluid outlet port integrally formed on said rear body.

2. The variable displacement pump according to claim 1, wherein said spool valve chamber comprises:

a spool having a first end and a second end capable of translational movement as a function of upstream pressure and downstream pressure between a first position and second position within said spool valve chamber;

a pressure relief valve having a third end and a fourth end within said spool valve chamber, said fourth end in closest proximity with said first end of said spool, said fourth end and said first end defining a first chamber;

a pressure relief spring coupled with said third end of said pressure relief valve;

a ball coupled with said pressure relief valve, said ball capable of translational movement between a third position and a fourth position as a function of first chamber pressure within said spool valve chamber;

a valve spring coupled with said second end of said spool and an inner wall of said spool valve chamber, said inner wall and said second end defining a second chamber;

a first passage located between said first chamber and a high-pressure chamber, said first passage exposed when said spool is in said first position;

a second passage located between said second chamber and a low-pressure chamber;

a rotor inlet passage for receiving fluid from said fluid inlet; and a relief valve outlet, said relief valve outlet exposed when said ball is in said third position; and a pressure relief passage coupled to said relief valve outlet, said pressure relief passage capable of carrying fluid from said first chamber to a reservoir.

3. The variable displacement pump according to claim 1, wherein said combination inlet port is integrally formed on said rear body.

4. The variable displacement pump according to claim 1, wherein said fluid outlet comprising a discharge chamber and an outlet chamber.

5. A variable displacement pump comprising:

a pump body having a front body and a rear body;

a fluid outlet port integrally formed on said rear body for delivering fluid from the variable displacement pump; and a combination inlet port formed integrally on said rear body, said combination inlet port comprising a fluid inlet and a spool valve chamber.

6. The variable displacement pump according to claim 5, wherein said spool valve chamber comprises:

a spool having a first end and a second end capable of translational movement as a function of upstream pressure and downstream pressure between a first position and second position within said spool valve chamber;

a pressure relief valve having a third end and a fourth end within said spool valve chamber, said fourth end in closest proximity with said first end of said spool, said fourth end and said first end defining a first chamber;

a pressure relief spring coupled with said third end of said pressure relief valve;

a ball coupled with said pressure relief valve, said ball capable of translational movement between a third position and a fourth position as a function of first chamber pressure within said spool valve chamber;

a valve spring coupled with said second end of said spool and an inner wall of said spool valve chamber, said inner wall and said second end defining a second chamber;

a first passage located between said first chamber and a high-pressure chamber, said first passage exposed when said spool is in said first position;

a second passage located between said second chamber and a low-pressure chamber;

a rotor inlet passage for receiving fluid from said fluid inlet; and a relief valve outlet, said relief valve outlet exposed when said ball is in said third position; and a pressure relief passage coupled to said relief valve outlet, said pressure relief passage capable of carrying fluid from said first chamber to a reservoir.

7. The variable displacement pump according to claim 5, wherein said fluid outlet comprising a discharge chamber and an outlet chamber.

* * * * *